US005572104A

United States Patent [19]

Nold et al.

[11] Patent Number: 5,572,104

[45] Date of Patent: Nov. 5, 1996

[54] FURNACE CONTROL APPARATUS

[75] Inventors: Craig M. Nold, Lexington; Mark E. Miller, Versailles; Mitchell R. Rowlette, Berea; Robert B. Brown, Lexington, all of Ky.

[73] Assignee: Texas Instruments Incorporated, Dallas, Tex.

[21] Appl. No.: 495,134

[22] Filed: Jun. 27, 1995

Related U.S. Application Data

[60] Continuation of Ser. No. 105,790, Aug. 12, 1993, abandoned, which is a division of Ser. No. 886,275, May 20, 1992, Pat. No. 5,272,427.

[51] Int. Cl.[6] ..... G05B 13/02; F24H 3/00; G05D 29/00

[52] U.S. Cl. ..... 318/672; 318/459; 388/907.5

[58] Field of Search ..... 318/567, 672, 318/62, 102, 459, 471; 388/907, 934, 907.5

[56] References Cited

U.S. PATENT DOCUMENTS

| | | | |
|---|---|---|---|
| 4,356,525 | 10/1982 | Kornrumpf et al. . | |
| 4,465,956 | 8/1984 | Fowler . | |
| 4,716,409 | 12/1987 | Hart et al. . | |
| 4,745,515 | 5/1988 | Fowler . | |
| 4,896,083 | 1/1990 | Kopala et al. . | |
| 4,990,908 | 2/1991 | Tung . | |
| 5,272,427 | 12/1993 | Nold et al. | 318/672 |

*Primary Examiner*—Bentsu Ro

*Attorney, Agent, or Firm*—Russell E. Baumann; Richard L. Donaldson; René E. Grossman

[57] ABSTRACT

An electric control for gas furnaces which controls a two speed main blower fan and an induction draft fan based on inputs from a room thermostat, a high limit and an ignition control including a gas valve. The control has a circuit board having a power supply for providing 24 volts DC current source to drive DC relays and a 5 volt DC power source to power a microprocessor. 24 volt AC input signals are coupled to the input ports of the microprocessor through current limiting resistors and to AC ground through pull down resistors. AC ground is also connected to the IRQ port of the microprocessor. The output ports of the microprocessor are connected to a relay driver which in turn is connected to the relays. Several breakaway tabs in the board provide optional features such as eliminating a normally provided draft delay timing function. Test pads are provided on the board so that the board can be tested during manufacture. An optional feature is shown comprising an LED which can be used to indicate the status of the system. Another optional feature incorporates a zener diode and resistor coupled to each input port to increase input thresholds. This feature is provided for use with power stealing electronic thermostats.

The control calibrates itself on a continuing periodic basis to read the AC inputs synchronously at the peak of their wave and switches the relays asynchronously based on the real time clock of the microprocessor.

8 Claims, 19 Drawing Sheets

PART 1

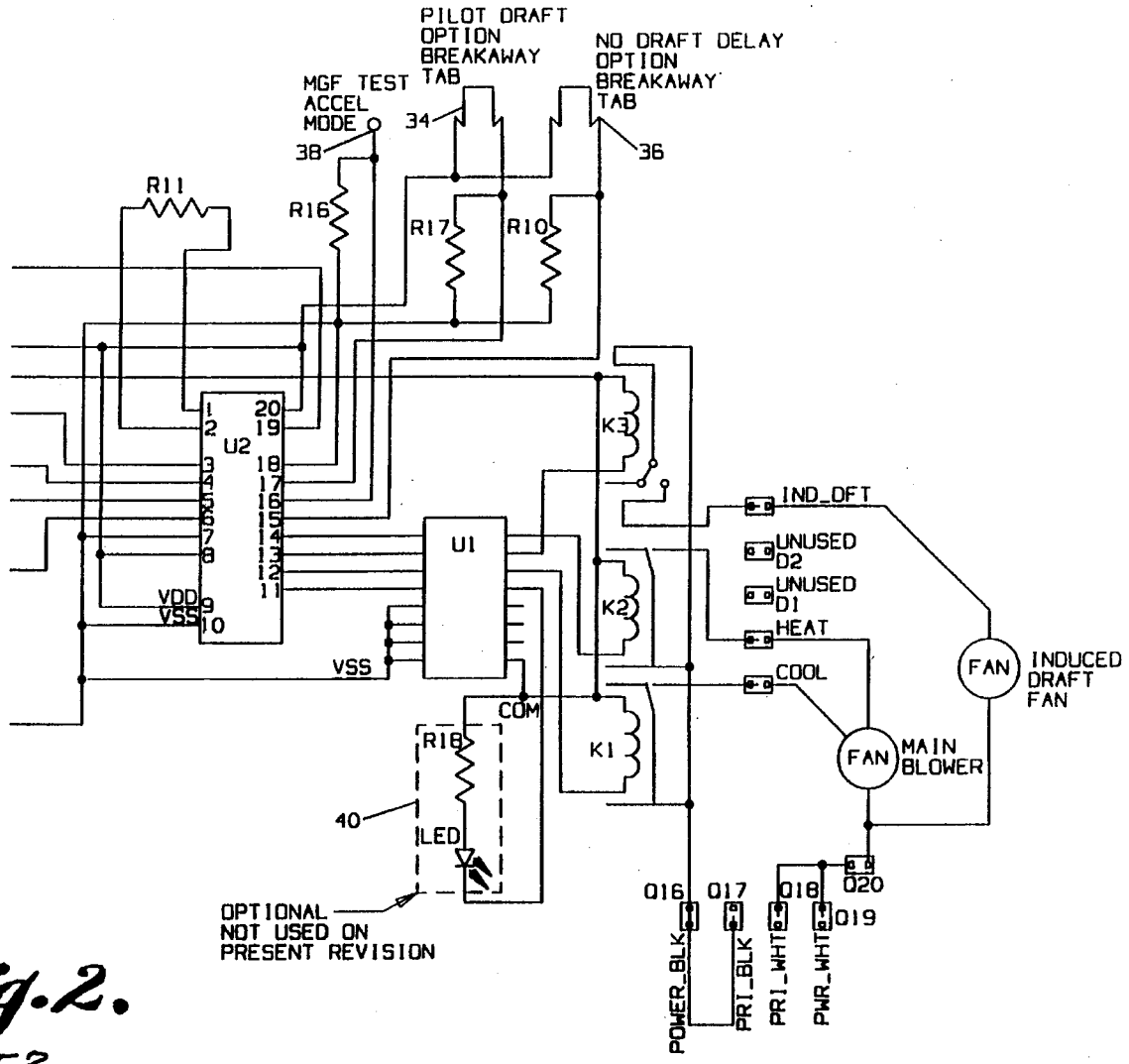
Fig. 2. PART 2

PROGRAM OVERVIEW

OUTPUT ROUTINE

COUNTER ROUTINE

INDUCED DRAFT OUTPUT ROUTINE

MEMORY MAP

COUNTERS

GOFFCTR
IDOFFCTR
MVOFFCTR
MVOFFCTR

FLAGS

GFLAG1, GFLAG2
WFLAG1, WFLAG2
MVONFLAG
MVOFFLAG1, MVOFFLAG2

248

| | 7 | 6 | 5 | 4 | 3 | 2 | 1 | 0 |
|---|---|---|---|---|---|---|---|---|
| FLAGREG1 | RFLAG | GFLAG1 | GFLAG2 | WFLAG1 | WFLAG2 | MVOFFLAG1 | MVOFFLAG2 | MVONFLAG |

250

| | PB 7 | 6 | 5 | 4 | 3 | 2 | 1 | 0 |
|---|---|---|---|---|---|---|---|---|
| INPUTS | | | G/EON | R/LIMIT | W1 | MV | | W2 |

252

| | 7 | 6 | 5 | 4 | 3 | 2 | 1 | 0 |
|---|---|---|---|---|---|---|---|---|
| FLAGREG2 | COOL | HEAT | IND DFT | | CL_HTFLAG | HT_CLFLAG | TIMEOUT2 | TIMEOUT1 |
| | PA2 | PA1 | PA0 | | | | | |

254

| | 2 | 1 | 0 |
|---|---|---|---|
| OUTPUTS | COOL | HEAT | IND DFT |

Fig.14.

HEAT TRUTH TABLE

| INPUTS | | | | OUTPUT |
|---|---|---|---|---|
| RFLAG | MVONFLAG | MVOFFLAG1 | MVOFFLAG2 | HEAT |
| 0 | 0 | 0 | 0 | 1 |
| 0 | 0 | 0 | 1 | 1 |
| 0 | 0 | 1 | 0 | 1 |
| 0 | 0 | 1 | 1 | 1 |
| 0 | 1 | 0 | 0 | 1 |
| 0 | 1 | 0 | 1 | 1 |
| 0 | 1 | 1 | 0 | 1 |
| 0 | 1 | 1 | 1 | 1 |
| 1 | 0 | 0 | 0 | 0 |
| 1 | 0 | 0 | 1 | 1 |
| 1 | 0 | 1 | 0 | 1 |
| 1 | 0 | 1 | 1 | 1 |
| 1 | 1 | 0 | 0 | 0 |
| 1 | 1 | 0 | 1 | 1 |
| 1 | 1 | 1 | 0 | 1 |
| 1 | 1 | 1 | 1 | 1 |

Fig. 15.

COOL TRUTH TABLE

| INPUTS | | OUTPUT |
|---|---|---|
| G/ECON | GDLYOFF | COOL |
| 0 | 0 | 0 |
| 0 | 1 | 1 |
| 1 | 0 | 1 |
| 1 | 1 | 1 |

Fig. 16.

INDUCED DRAFT TRUTH TABLE

| INPUTS | | | | OUTPUT |
|---|---|---|---|---|
| RFLAG | MVONFLAG | WFLAG1 | WFLAG2 | IND DFT ON |
| 0 | 0 | 0 | 0 | 1 |
| 0 | 0 | 0 | 1 | 1 |
| 0 | 0 | 1 | 0 | 1 |
| 0 | 0 | 1 | 1 | 1 |
| 0 | 1 | 0 | 0 | 1 |
| 0 | 1 | 0 | 1 | 1 |
| 0 | 1 | 1 | 0 | 1 |
| 0 | 1 | 1 | 1 | 1 |
| 1 | 0 | 0 | 0 | 0 |
| 1 | 0 | 0 | 1 | 1 |
| 1 | 0 | 1 | 0 | 1 |
| 1 | 0 | 1 | 1 | 1 |
| 1 | 1 | 0 | 0 | 1 |
| 1 | 1 | 0 | 1 | 1 |
| 1 | 1 | 1 | 0 | 1 |
| 1 | 1 | 1 | 1 | 1 |

Fig. 17.

FURNACE CONTROL APPARATUS

This application is a continuation of application Ser. No. 08/105,790, filed Aug. 12, 1993, now abandoned, which is a division of application Ser. No. 07/886,275, filed May 20, 1992, now U.S. Pat. No. 5,272,427.

BACKGROUND OF THE INVENTION

This invention relates generally to furnace controls and more specifically to microprocessor based gas furnace controls.

Typically, the control of gas furnaces includes the control of main and induced draft fan motors having selected time delays in conjunction with an ignition control, gas valve and thermostat.

Control of these functions by a microprocessor is known; however, such controls have suffered from the limitation that their timing mechanisms have been more erratic than desirable. Utilizing IC networks such as internal oscillator for timing results in an unsatisfactory tolerance with timing varying plus or minus fifty percent or more. Not only does the timing vary within a particular microprocessor but also from one microprocessor to another. There is a need to provide a control which has significantly improved reliability, particularly in relations to providing consistent timing functions over a wide temperature range, e.g., from minus 40° C. To 85° C.

It is an object of the present invention to provide a control for gas furnace controls which has improved, consistent and reliable timing.

Another object is the provision of a microprocessor control which has timing consistency within plus or minus ten percent over a temperature range of minus 40° C. to 85° C.

Yet another object of the invention is the provision of a microprocessor furnace control which is of relatively low cost, reliable and one which results in improved relay contact life.

BRIEF SUMMARY OF THE INVENTION

Briefly, in accordance with the invention, a control circuit controls the heat speed and cool speed of a fan motor based on inputs from a room thermostat, a gas valve and a high limit switch. All the control inputs are 24 VAC signals which are inputted to a microprocessor through current limiting resistors and with the IRQ input connected to the 24 VAC transformer common which, according to a feature of the invention, is used to provide a reference point for reading the input signals. The microprocessor outputs directly drive a relay driver in the form of an array of darlington transistors which operate DC relays. The control circuit has a power circuit providing 24 VAC and a full wave rectified voltage to power the relays as well as 5 VDC required for the microprocessor.

According to a feature of the invention a calibration routine is executed upon initialization and on an ongoing basis to synchronize readings of the AC inputs. The input routine executes as an IRQ interrupt routine and reads the inputs at the peak of the AC signal and must read a selected number of good readings before updating an input register. A one second flag is also derived from this 60 hertz input routine.

According to another feature of the invention the output is executed based on the Real Time Interrupt Clock which operates from the internal oscillator which is asynchronous to the 60 hertz line frequency. The output port is updated with the contents of the output register on every interrupt.

According to another feature of the invention the main control program causes the inputs to be read and flags set for the present and previous states and based on the status of the flag registers the output register is updated. Timing functions are performed using the one second clock and counting registers. The program verifies that the interrupt routines are working before executing the main program. If an interrupt does not occur within the watchdog period the microprocessor is reset. When the outputs are idle the microprocessor generates an internal reset every 256 seconds.

According to a feature of the invention when the IRQ line is at DC a test sequence occurs on the inputs with the part number, revision number and status outputted. The microprocessor can be put into an accelerated timing mode for further testing.

In a modified embodiment particularly adapted for use with electronic thermostats a selected pull down resistor is connected to the input signal lines along with a zener diode. This results in increased switching threshold voltages from the thermostat and allows compatibility with power stealing thermostats.

BRIEF DESCRIPTION OF THE DRAWINGS

FIG. 14 is a memory map;

FIGS. 15–17 are truth tables for heat and cool speeds and induced draft fans respectively.

DETAILED DESCRIPTION OF THE DRAWINGS

Figure 1:
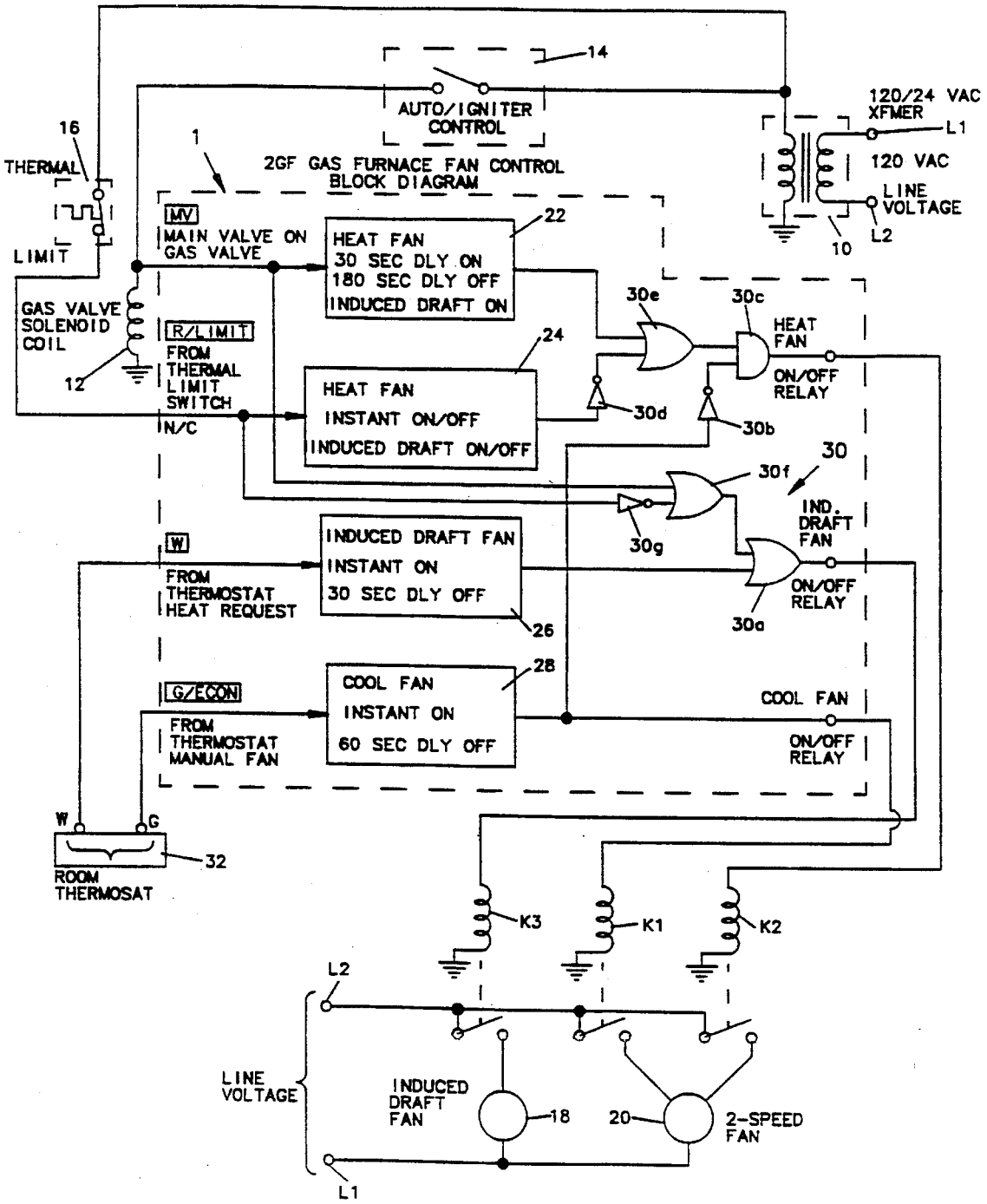
FIG. 1 is a schematic of a system in which a circuit board made in accordance with the invention is used with the board shown by functions performed by the control.

With particular reference to FIG. 1 the several components of the system are shown along with a schematic representation of the functions provided by the control made in accordance with the invention.

A 120/24 VAC transformer 10 provides 24 volt AC power to a gas valve solenoid coil 12 and MV terminal on control board 1 through autoigniter control 14. The 24 volt AC power is also connected through a thermal limit 16 to R/Limit terminal on control board 1. Terminals W and G of a room thermostat 32 are connected respectively to terminals W and G/ECON on board 1.

An induced draft fan motor 18 and a two speed fan motor 20 are shown connected across line voltage L1, L2. Energization of fan motor 18 is controlled by a relay coil K3 from an output on board 1 and energization of cool speed and heat speed of fan motor 20 are controlled respectively from outputs on board 1 by relay coils K1 and K2.

Control board 1 is shown with functional blocks 22, 24, 26 and 28. Block 22, which receives an input from terminal MV, main valve, provides a heat fan energization signal with a selected time delay of 30 seconds on and 180 seconds off and an instantaneous induced draft fan energization. Block 24, which receives an input through normally closed thermal limit switch 16, provides a heat fan energization signal, instant on and off and induced draft fan energization, instant on and off. Block 26, which receives a heat request input from terminal W of room thermostat 32, provides an induced draft fan energization signal, instant on and a thirty second delay off. Block 28, which received a manual cool fan request input from room thermostat 32, provides a cool fan motor energization signal, instant on and a sixty second delay off.

Also shown in FIG. 1 are a group of symbols 30 used to describe the logic inter-relating the various inputs to provide the desired functional outputs which are actually provided in the software routines to be discussed below.

Thus a G signal received from room thermostat 32 turns on the cool fan instantly which remains on for sixty seconds after the signal is turned off at the room thermostat. A W or a heat request signal from the room thermostat is shown going through an OR gate 30*a* results in the induced draft fan being turned on instantly and remaining on for thirty seconds after the W signal is turned off at the thermostat.

A G input is also shown connected through an invertor 30*b* to an AND gate 30*c* whose output is connected to the heat fan coil K2 so that an on or high signal from block 28 will be converted to a low signal being input to AND gate 30*c* indicating that a cool speed fan request will override a heat speed fan request.

Thermal limit switch 16 is normally always energized providing a high input to block 24, which is inverted to a low through invertor 30*d*, and a normal low input to OR gate 30*e*. When autoigniter control 14 is energized a high will be input to block 22 which will result in a high output from OR gate 30*e* and, assuming a low cool fan signal, will result in a high from AND and gate 30*c* thereby energizing heat from relay coil K2. Energization of the gas valve 12 also provides a high input into OR gate 30*f* which in turn provides a high input to OR gate 30*a* to energize induced draft fan relay coil K3.

If thermal limit switch 16 opens because of a fault condition it provides a low input to invertor 30*g* which results in a high input to OR gate 30*f* thereby providing a high input to OR gate 30*a* and energization of induced draft fan 18. In addition, unless there is a signal calling for cool fan energization then the opening of thermal limit 16 will cause energization of heat fan relay coil K2 by providing a low input to invertor 30*d* which is changed to high input to OR gate 30*e* and a high input to AND gate 30*c*.

Figure 2:
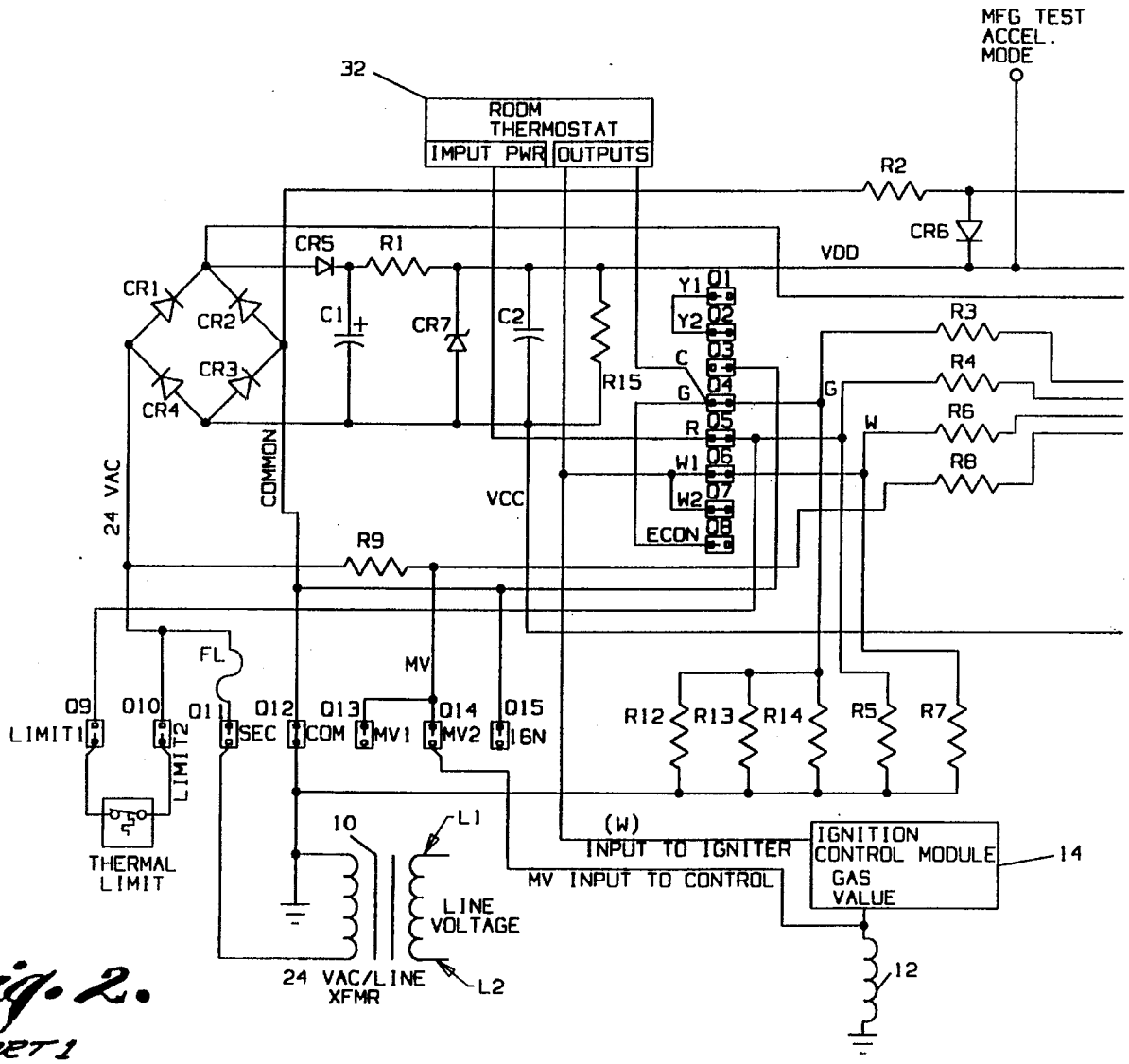
FIG. 2 Part 1 and Part 2 together are a schematic of the FIG. 1 system in which the structural components of the circuit board is shown.
Figure 2A:
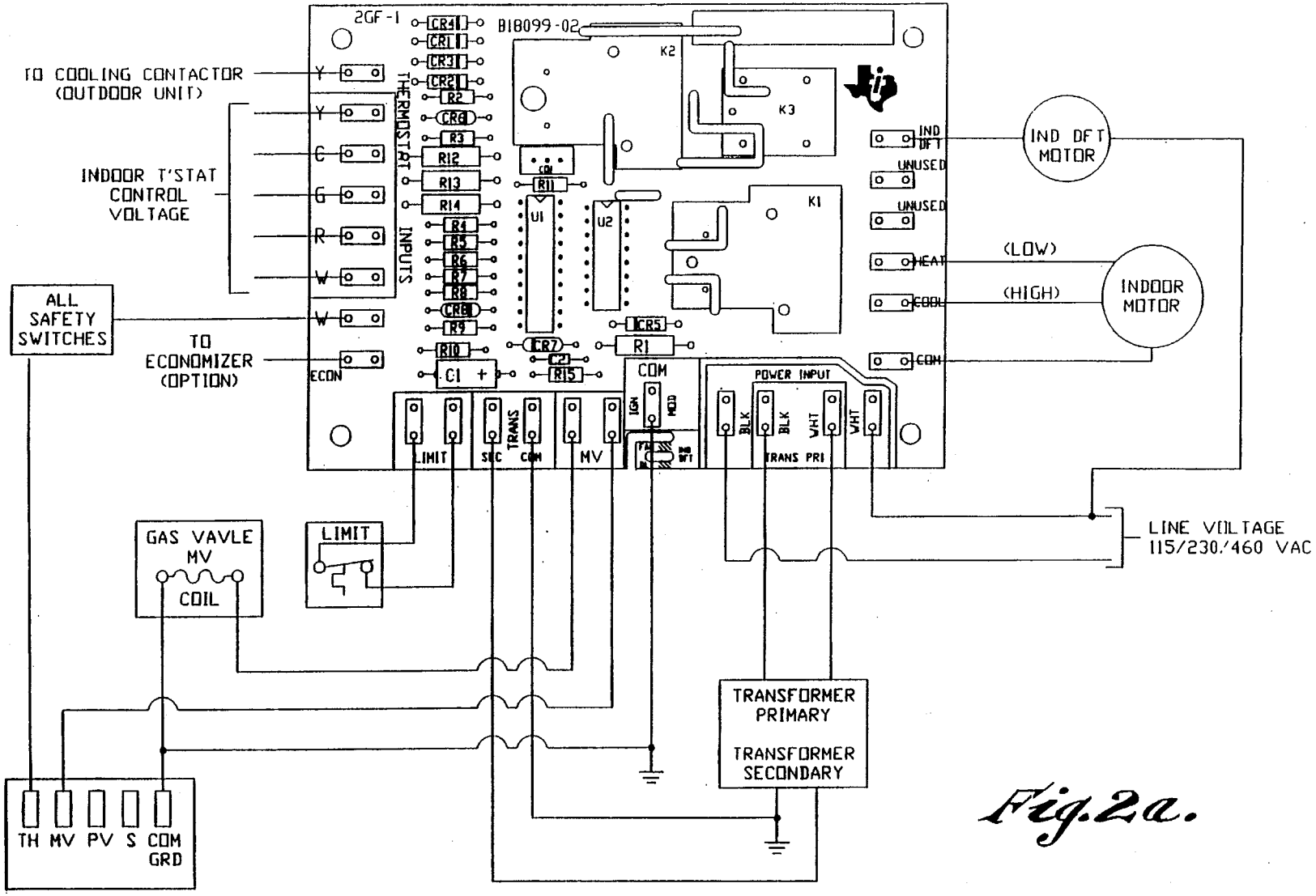
FIG. 2*a* shows the component layout on the circuit board along with the connections to the several system components.

Turning now to FIG. 2 a schematic representation is shown of a control circuit made in accordance with the invention along with other components of a gas furnace system with which the control circuit is used. Transformer 10, providing 24 volts AC from line voltage, is connected at the 24 VAC output side to connected Q11 and then through a 5 amp fuse F1 to a full wave bridge comprising diodes CR1, CR1, CR3 and CR4. The transformer common is connected to the bridge through connector Q12. The bridge provides full wave rectified 24 VAC power to drive relays K1, K2 and K3 to be discussed below. Zener diode CR7 suppresses both EMF. Capacitor C2, resistor R15 and capacitor C1, resistor R1 provide 5 volts DC on line VDD for the power supply of microprocessor U2 to be discussed below.

There are several low voltage AC input terminals labeled Y1, Y2, C, G, R, W1, W2 and ECON. Terminals Y1, Y2 are not used in the present embodiment. Terminal C is connected to the transformer common, terminal G is coupled to an output of room thermostat 32 and to input port 3 of microprocessor U2 through a 100K ohm resistor R3 and is connected to common through pull down resistors R12, R13, R14 of 1.5 ohms connected in parallel to provide an equivalent resistance of 500 ohms. Terminal G is also connected to the terminal ECON. A signal on the G terminal results in energizing the manual fan as well as providing a cool request as will be explained further below. Terminal W is coupled to an output of room thermostat 32 and to the ignition control module 14, the other side of which is connected to common through the gas valve solenoid coil 12 and to connector Q14. Terminal W1, interconnected with terminal W2, is connected to input port 5 of microprocessor U2 through limiting resistor R6 of 100K ohms and to common through pull down resistor R7 of 50K ohms. Connector Q14 is connected to the 24 VAC output of transformer 10 through 100K ohm pull up resistor R9 and to input port 6 of microprocessor U2 through limiting resistor R8 of 100K ohms. It should be noted that there is no separate pull down resistor required since the main valve itself serves as a pull down resistor. Pull up resistor R9 serves as a safety feature. That is, if for any reason, the gas valve is not correctly wired to the control circuit since there is no pull down resistor to common pull up resistor R9 will always provide a high input thereby turning the induced draft fan on.

Another input to microprocessor U2 is IRQ port 19 which is a common input received through 100K ohm resistor R2. Clamping diode CR6 connected between port 19 and the 5 volt supply VDD drops the input at 5 volts.

Microprocessor U2 has two additional, optional inputs provided by breakaway tabs 34, 36. Input port 15 is connected to the 5 volt supply VDD through breakaway tab 36 and to DC ground or common VSS through 10K ohm resistor R10. Normally the system provides a selected period of time that the draft fan is maintained in the energization condition after its energization signal has been removed. This occurs when port 15 is pulled high by its connection with the 5 volt supply VDD. However, if tab 36 is broken off resistor R10 will pull port 15 to ground providing a low. Then the draft fan is turned off at the same time its energization signal has been removed.

Similarly, port 17 is connected to the 5 volt supply VDD through tab 34 and to ground VSS through 10K ohm resistor R17. Tab 34 provides a pilot draft option.

Reference numeral 38 indicates a wiring point which is used for testing the control. That is, by placing a 5 volt DC input at point 38 the control is placed in a test mode in effect shortening all the normal time delays. Point 38 is connected to port 16 of microprocessor U2 and ground through 10K ohm resistor R16. DC ground VSS is also connected to ports 10 and 7 of microprocessor U2.

Output ports 11–14 are connected to relay driver integrated circuit U1 at pins 7, 6, 5 and 4 respectively. Relay driver U1 comprises a transistor network which, in effect, switch on relays K1, K2, K3 when the base of the transistors receive an input signal from microprocessor U2. Output pin 12 of relay driver U1 is connected to the coil of relay K3 which has a common contact connected to power connectors Q16, Q17 and a normally open contact connected to connector Q25.

Power connectors Q16, Q17 are connected to switching mechanism in respective relays K1, K2, K3. Energization of the relay coil of relay K1 through output port 11 will cause the switch to connect power to terminal Q21, the cool speed of the fan motor. Energization of the relay coil of relay K2 through output port 13 will cause the switch to connect power to terminal Q22, the heat speed of the fan motor. Energization of the relay coil of relay K3 through output port 12 will cause the switch to connect power to terminal Q25, the induced draft fan motor.

An optional feature is shown at the dashed line box identified by numeral 40 comprising resistor R18 serially connected to LED between pin 10 of relay drive U1 and common, pin 9. This feature provides a flashing or continuous LED based on the state of the inputs.

Resistor R11 of 39K ohms is connected to pins 1 and 2 of microprocessor U2 to provide a selected rate of oscillation for the internal clock.

The control board is provided with Q9 and Q10 to connect the high limit switch. The high limit switch is normally closed but adapted to open upon an over temperature condition. An economizer function is tied to terminal G. This can be used as an output in a system having an economizer, i.e., an option which, for example, opens a duct to outside fresh air when the manual fan is on.

Figure 3:
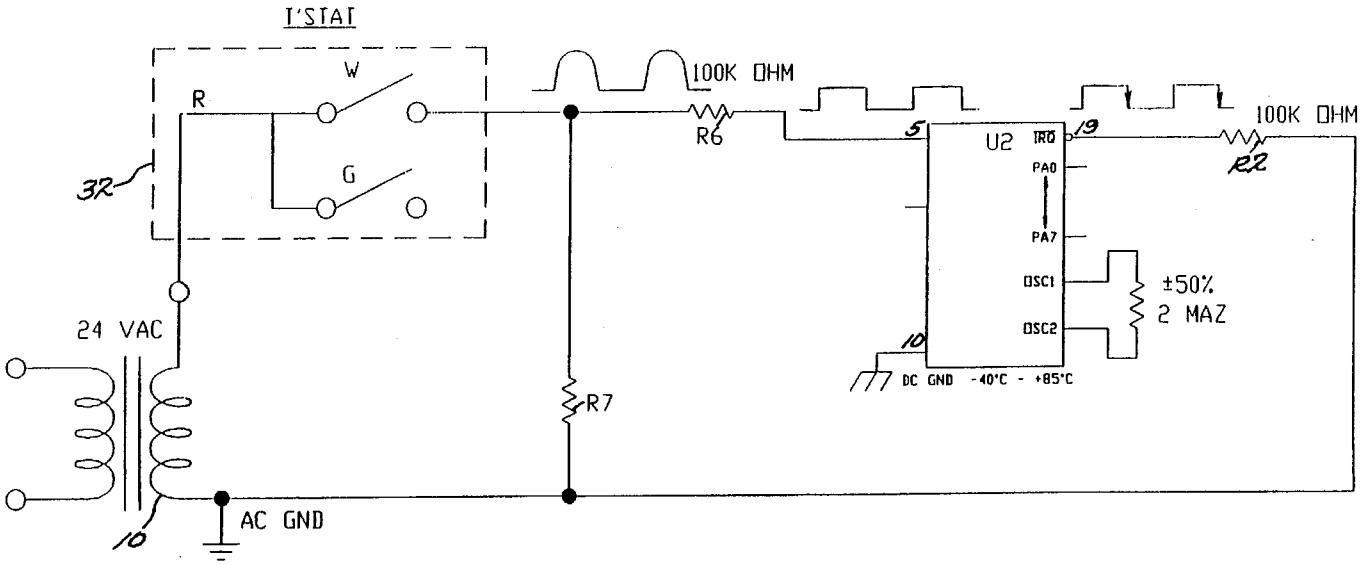
FIG. 3 is a simplified version of FIG. 2 showing one of the AC input signal lines and the microprocessor and several wave forms.
Figure 3A:
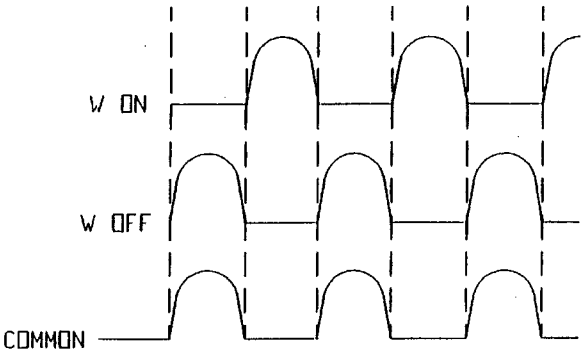
FIG. 3*a* depicts wave forms relating to FIG. 3.

With reference to FIG. 3 which is a simplified portion of FIG. 2, one of the inputs will be described. With respect to the W terminal, due to the internal structure of the CMOS microprocessor which includes intrinsic diodes on both the P and N channels of the FETs which serve to limit input voltage to 5 volts, a simple current limiting resistor R6 can be inputted to port 5 of microprocessor U2 along with a resistor R7 tied to common. When the room thermostat 32 provides a heat request signal by connecting 24 VAC from transformer 10 a wave form on the W line is shown in FIG. 3*a* as $W_{on}$. When terminal W is not energized port 5 of the microprocessor is tied to common with its wave form shown at $W_{off}$, which is the same as common.

Figure 4:
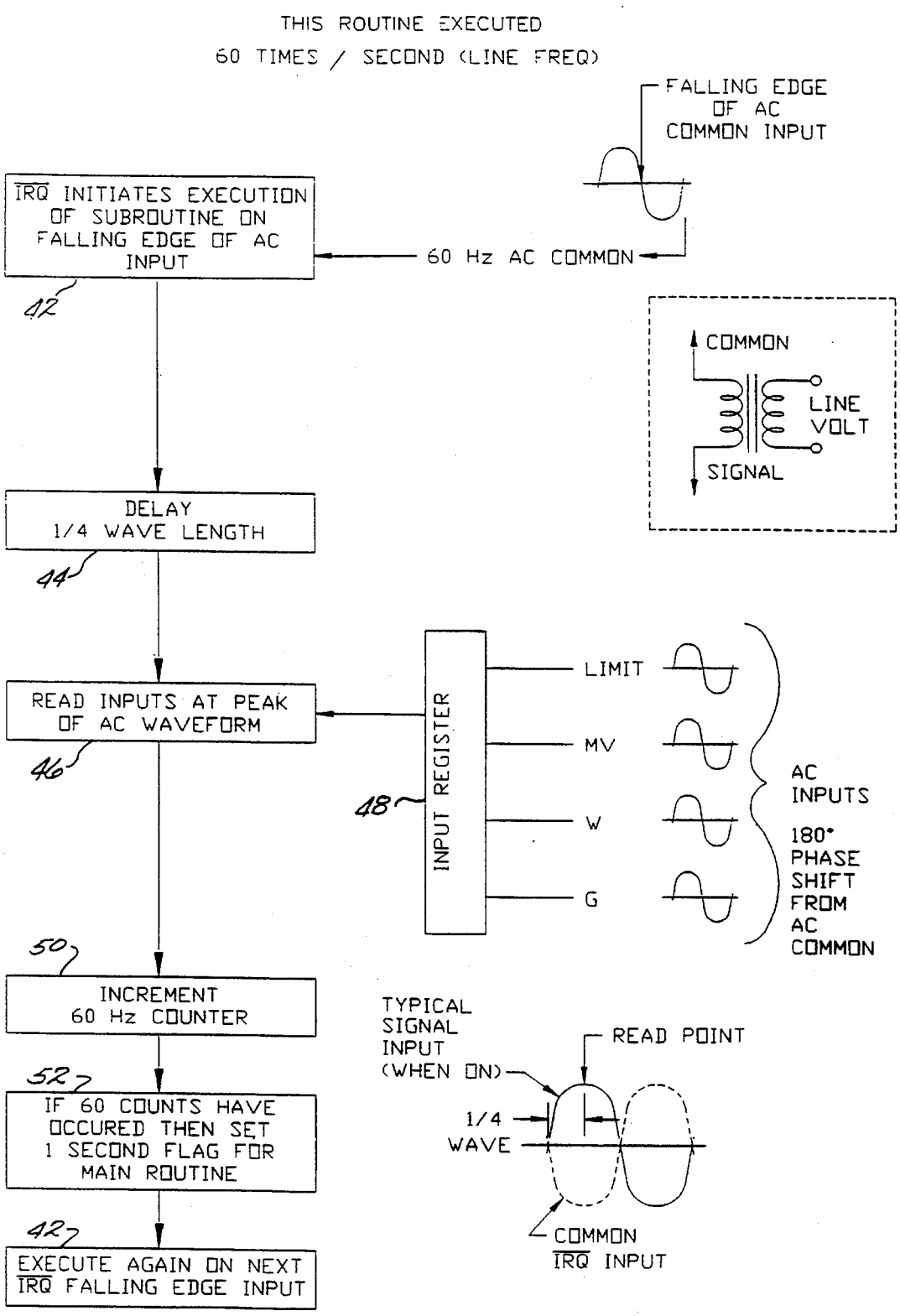
FIG. 4 shows key steps of an input reading routine used in accordance with the invention along with explanatory material inter-relating signal and common wave forms.

The 5 volt DC ground coming from the diode bridge is shown at port 10. With respect to DC ground the microprocessor sees a half wave which, because of the diode clamping is a square wave having the line frequency of 60 HZ, the phase of which depends on whether the W terminal is closed or open. When the terminal is closed the wave is 180° out of phase with the common voltage but when the terminal is open it is in phase with common voltage. In effect when the thermostat calls for heat a connection is made with the high side of the transformer, 180 degrees out of phase with common, and when it does not call for heat the connection is with the common of the transformer. AC common is connected to port 19, the IRQ or special interrupt port of microprocessor U2 through resistor R2. As indicated in FIG. 4, at the block 42 the IRQ initiates execution of a subroutine whenever it is exposed to the falling edge of an AC input. Thus that routine is directly tied to common and is executed on every falling edge of the square wave. According to the routine, block 44, there is a delay of a quarter of a wave length and then the input port, in this case port 5, block 46, is read and inputted to the input register 48 for use in the main routine and a 60 HZ counter is incremented, block 50. After sixty counts, block 52, (i.e., one second) a flag is set so that the timing information can be transferred to the main routine. Thus the subroutine is executed with the input register 48 updated on every falling edge of the 60 HZ wave.

The specific delay of a quarter of a wave length is determined by the relationship between the microprocessor clock and the AC clock or frequency. At the beginning of the main routine while the interrupt is masked a subroutine reads the real time clock counter then when the edge of the wave at port 19 goes high, an active low, the real time clock is read. When the IRQ goes low again (one cycle of the 60 HZ later) the real time clock is read again so that the number of clock pulses the oscillator has gone through during this cycle can be determined. The oscillator runs much faster, for example, in the order of 2 megahertz. The result, which varies from chip to chip, is used to synchronize the real time clock and the line clock and derive how many oscillations are in a quarter cycle. Once this calibration routine is accomplished a clear interrupt is generated so that the IRQ input is enabled to start working in the main program reading the input signals at the high point of the signal wave.

The relays are actuated asynchronously in order to have the contacts close randomly with respect to the AC line wave so that the load is more evenly distributed on the contacts. That is effected by using the real time or internal clock. A real time interrupt which counts directly from the oscillations at the real time clock sets a real time interrupt flag (RTIF) thereby generating an internal interrupt to execute a subroutine used for the output. When the real time interrupt flag is set the output section of the code is executed resulting in the asynchronous switching of the relay contacts.

Figure 5:
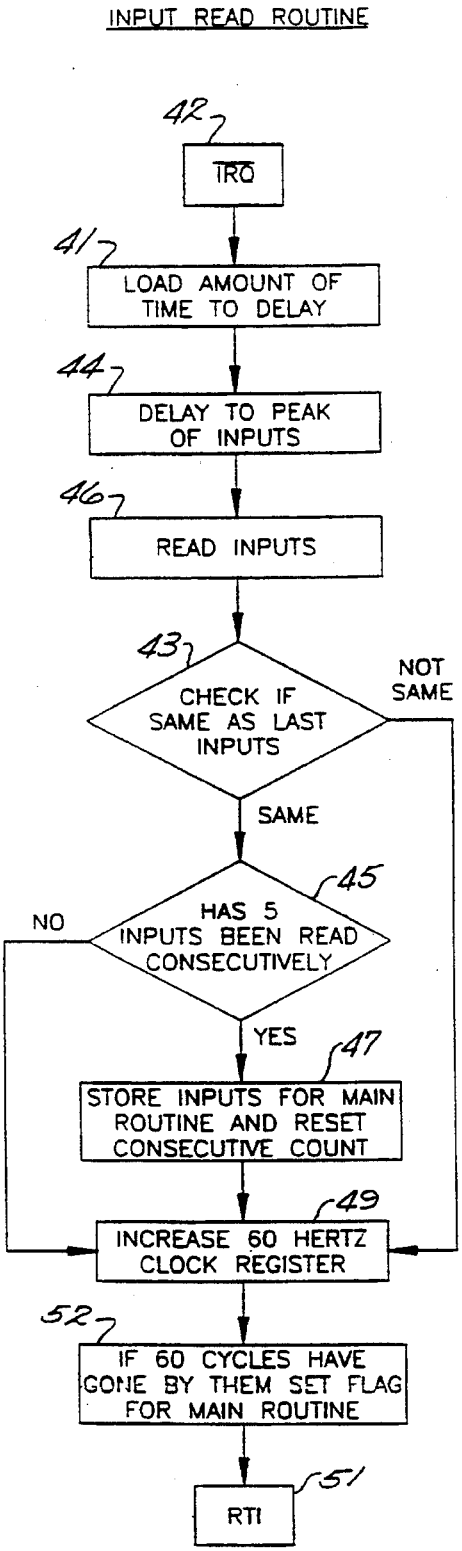
FIG. 5 is the input read routing of FIG. 4.

With respect to the specific routines, FIG. 5 shows the input read routine wherein the inputs are checked in relation to previous inputs to see if a sufficient number of good inputs have been read and if so a flag is set for the main routine. The routine is initiated at 42 with the time delay to the peak of the input wave at 41, 44 and the input read at 46. A decision block 43 checks to see if the input is the same as the previous inputs and if not the routine goes to processing block 49 which increases the 60 Hertz clock register. If the inputs are the same it moves to decision block 45 to see if 5 inputs have been read consecutively and if not again jumps to processing block 49. If 5 inputs have been read consecutively it goes to 47 storing inputs for the main routine and resets the consecutive count and then goes to block 49 and then, at 51 and 52 sets flag for the main routine.

Figure 6:
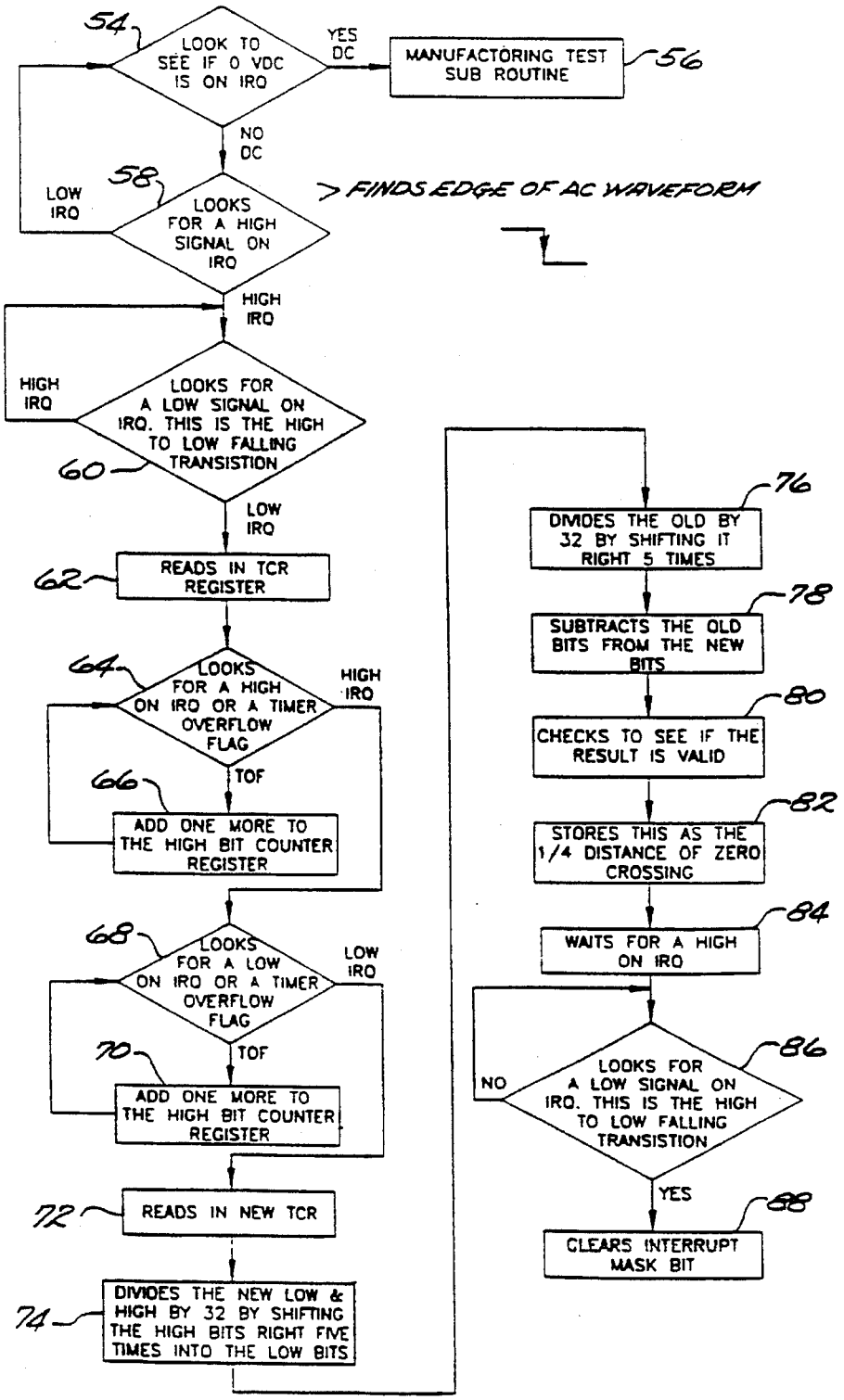
FIG. 6 is an input calibration routine used in accordance with the invention.

FIG. 6 shows the flow chart of the input calibration routing in which the IRQ port waits for a low to high transition to find the wave edge which is then read in the TCR register. Since the real time clock has limited capability overflows are counted in order to derive a quarter wave delay time. Essentially the number of internal clock cycles are counted for one AC clock cycle to go by from which the quarter wave delay time is derived. More specifically, the routine includes decision block 54 which checks to see if direct current is on IRQ port and if so goes into the manufacturing test subroutine 56 and if not goes to decision block 58 and looks for a high signal on IRQ port, if it is low it goes back to decision block 54 while if it is high it moves to decision block 60 where it looks for a high to low falling transition, i.e., a low signal on the IRQ port, if it is high it cycles around until it finds a low signal and moves to processing block 62 and reads into the TCR register and goes to decision block 64 where it looks for a high on IRQ port or a timer overflow flag. If it finds a timer overflow flag it adds one more to the high bit counter register at block 66 and goes back to decision block 64. If it finds a high on the IRQ port it goes to decision block 68 where it looks for a low on the IRQ port or a timer overflow flag. If it finds a timer overflow flag it adds one to the high bit counter register at 70 and then goes back to decision block 68 and if it finds a low on the IRQ port it goes to block 72 and reads in new TCR and then to processing block 74 where it divides the new low and high by shifting the high bits right five times into the low bits and then to block 76 where it divides the old by 32 by shifting it right five times and in block 78 subtracts the old bits from the new bits and at processing block 80 checks to see if the result is valid and at block 82 stores this result as the one quarter distance from zero crossing and then, at block 84, waits for a high on the IRQ port. The routine then goes to decision block 86 and waits for a low signal, the high to low falling transition, on the IRQ port and then at 88 clears interrupt mask bit.

Figure 7:
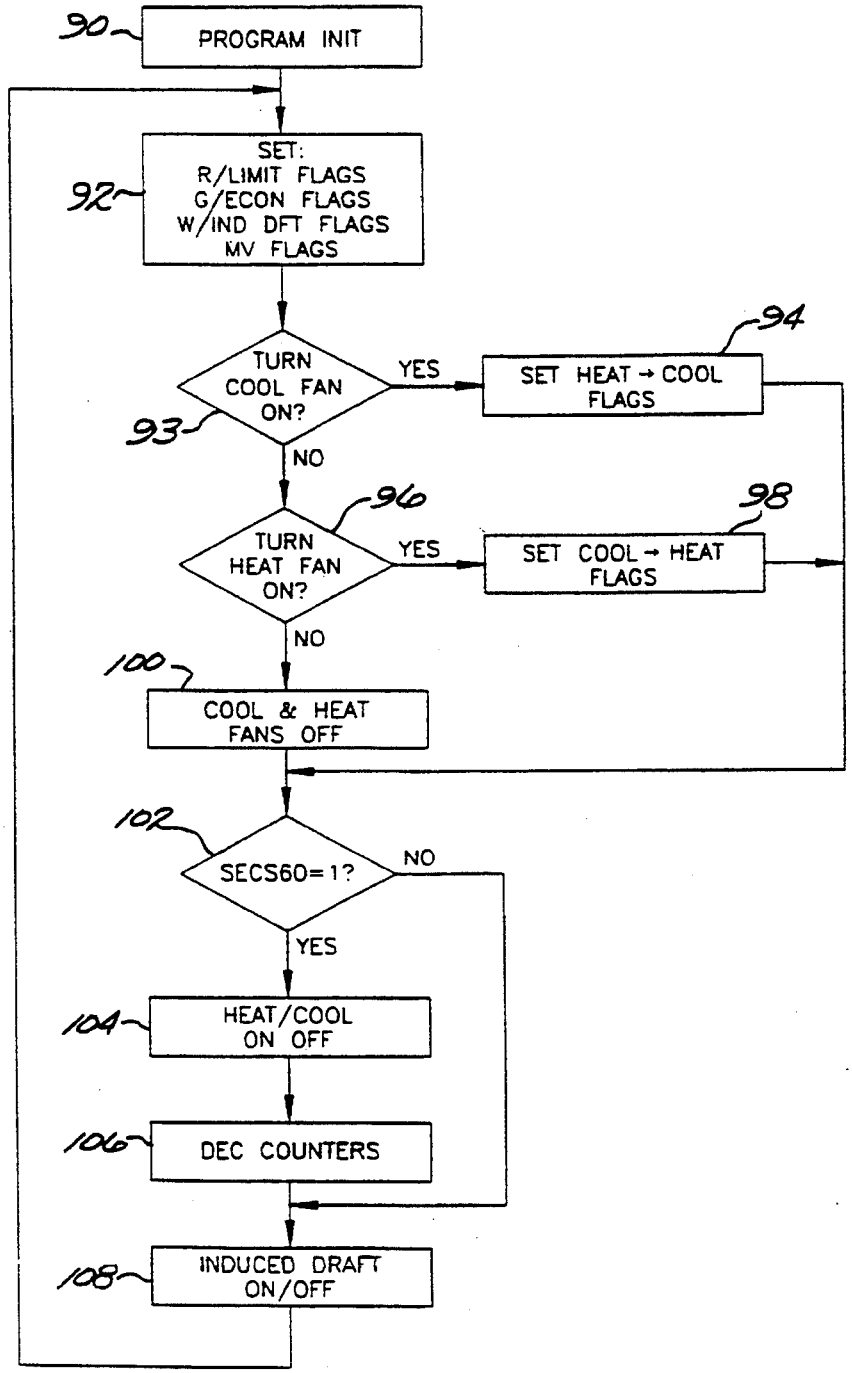
FIG. 7 is a main program overview.

FIG. 7 shows a simplified overview of the main program which assumes that everything is functioning as intended, i.e., the RTC (clock) is running, the interrupt routines are executing, etc. As the routine is initiated at 90 it takes the inputs and sets condition flags at 92. Then a decision is made at 92 whether the cool fan needs to be on and if so a flag is set at 94 to make the heat to cool transition. If the cool fan is not called for a decision is made at 96 regarding the turning on of the heat fan. If yes, the cool to heat transition flag is set at 98. If the heat fan is not called for then at 100 both heat and cool fans are off. It should be noted that the transitions are always set to avoid the possibilities that both receive a turn on signal at the same time. The routine then at 102 looks to see if one second has passed and if not goes to block 108. Every second the decrement counter is decremented turning the fans on and off as required at 104 and 106. The induced draft fan can be on at the same time the heat fan is on; therefore, it is not included in the sixty second routine. The flags are continuously checked but the induced fan is not turned on and off every second. If one of the flags is set, for example, a flag is set to change heat to cool, the first time through the routine heat speed receives an instruction to turn off for a second, then the next time through the instructions will be turn on the cool speed. This obviates contradictory signals. Whereas whenever the induced fan receives a signal to turn on it can do so without any delay.

Figure 8:
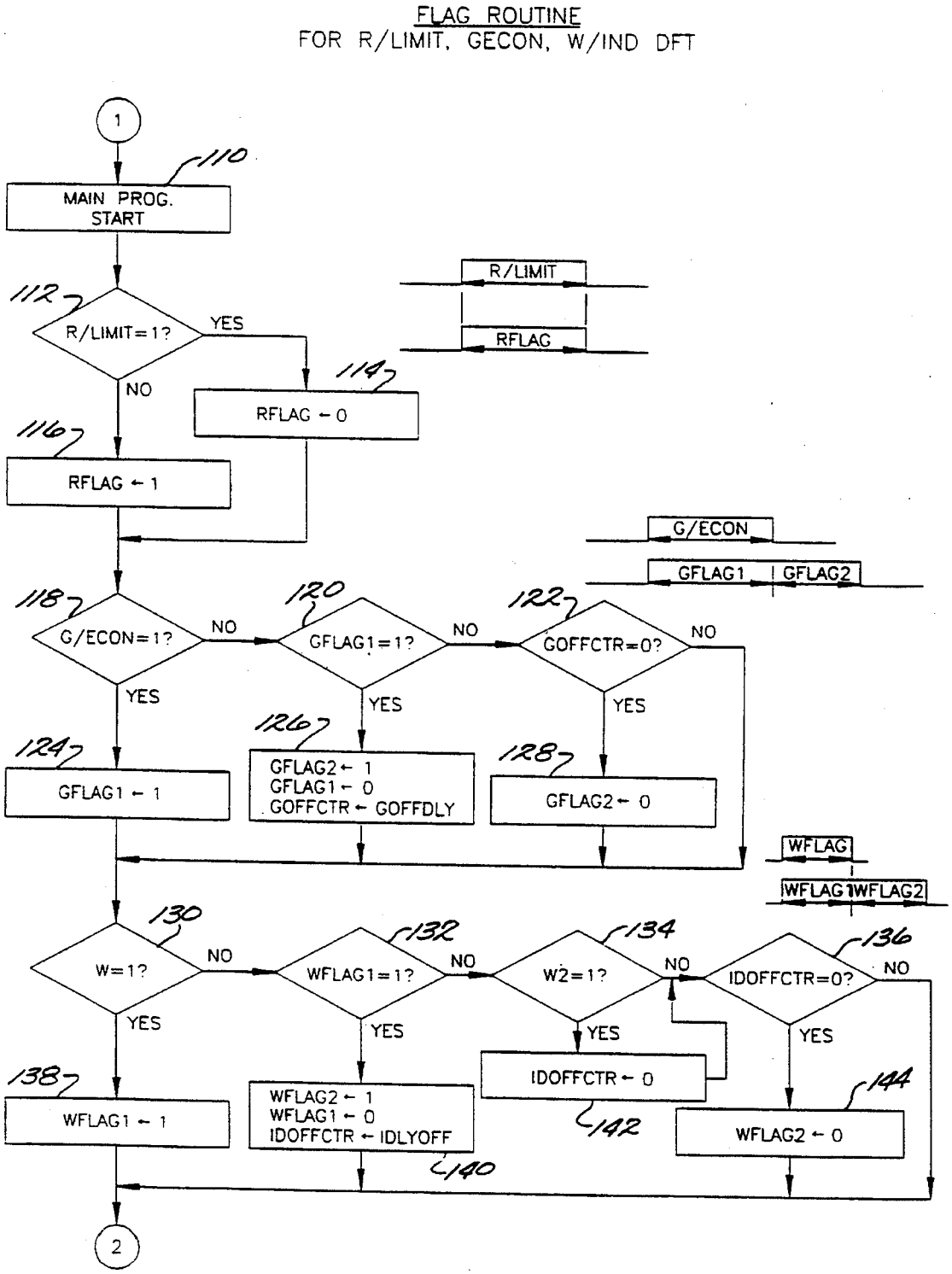
FIG. 8 is a flag routine for R/LIMIT, GECON; W/IND DFT.
Figure 9:
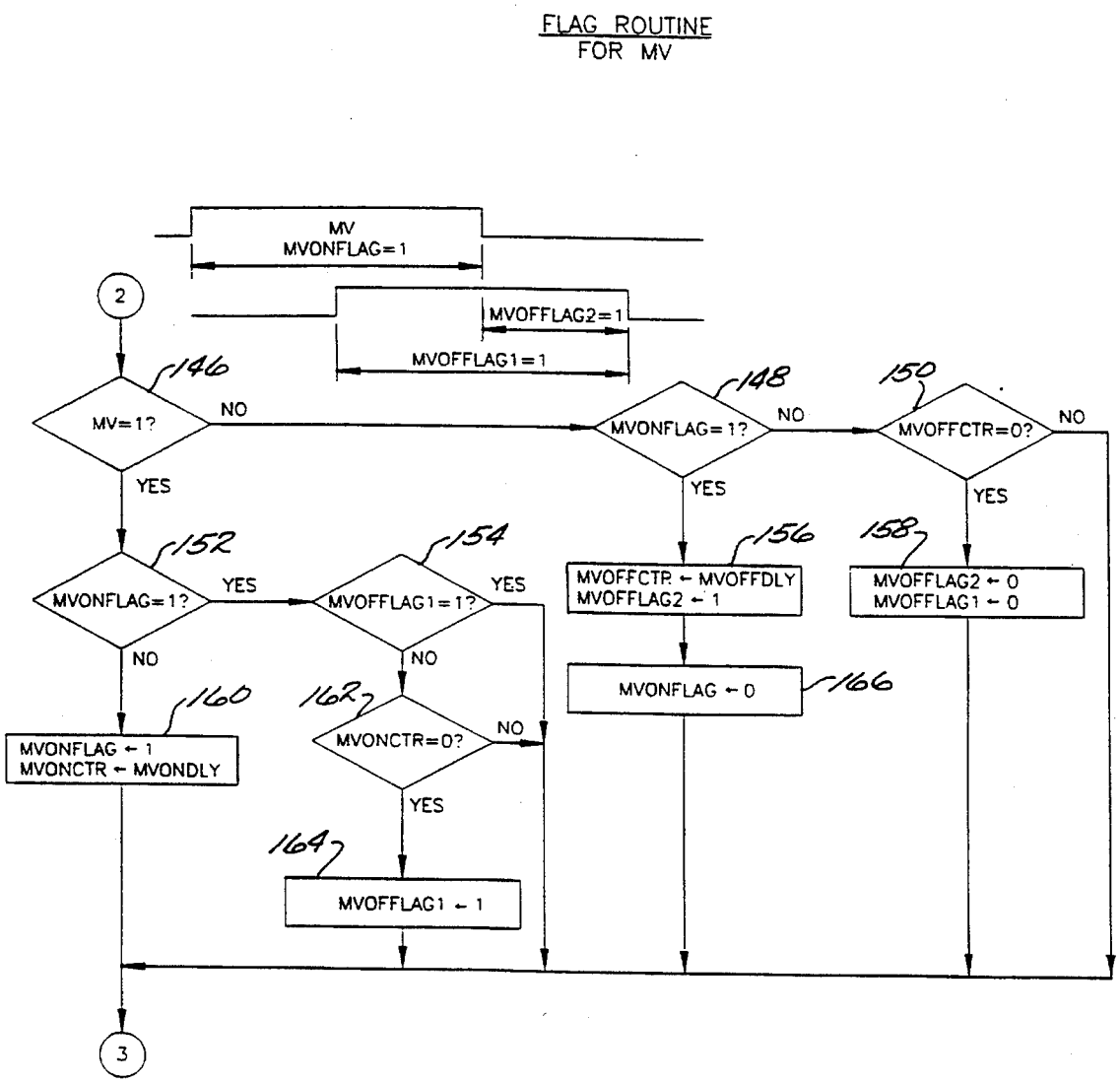
FIG. 9 is a flag routine for MV (main valve)

FIG. 8 shows the flag routine 110 for R/LIMIT, GECON and W/IND DFT and FIG. 9 for MV including decision and processing blocks 112–164 wherein the conditions of the limit flags are checked, what conditions they are in and where they have been in order to avoid the possibility of short cycling the routine and that the output routine has to finish completely. This is particularly important when some overlapping occurs, that is, competing signals for heat and cool speed fans. For example, the cool speed has a sixty second off delay and the heat speed a three minute off delay. The several flags keep track of these various conditions.

Figure 10:
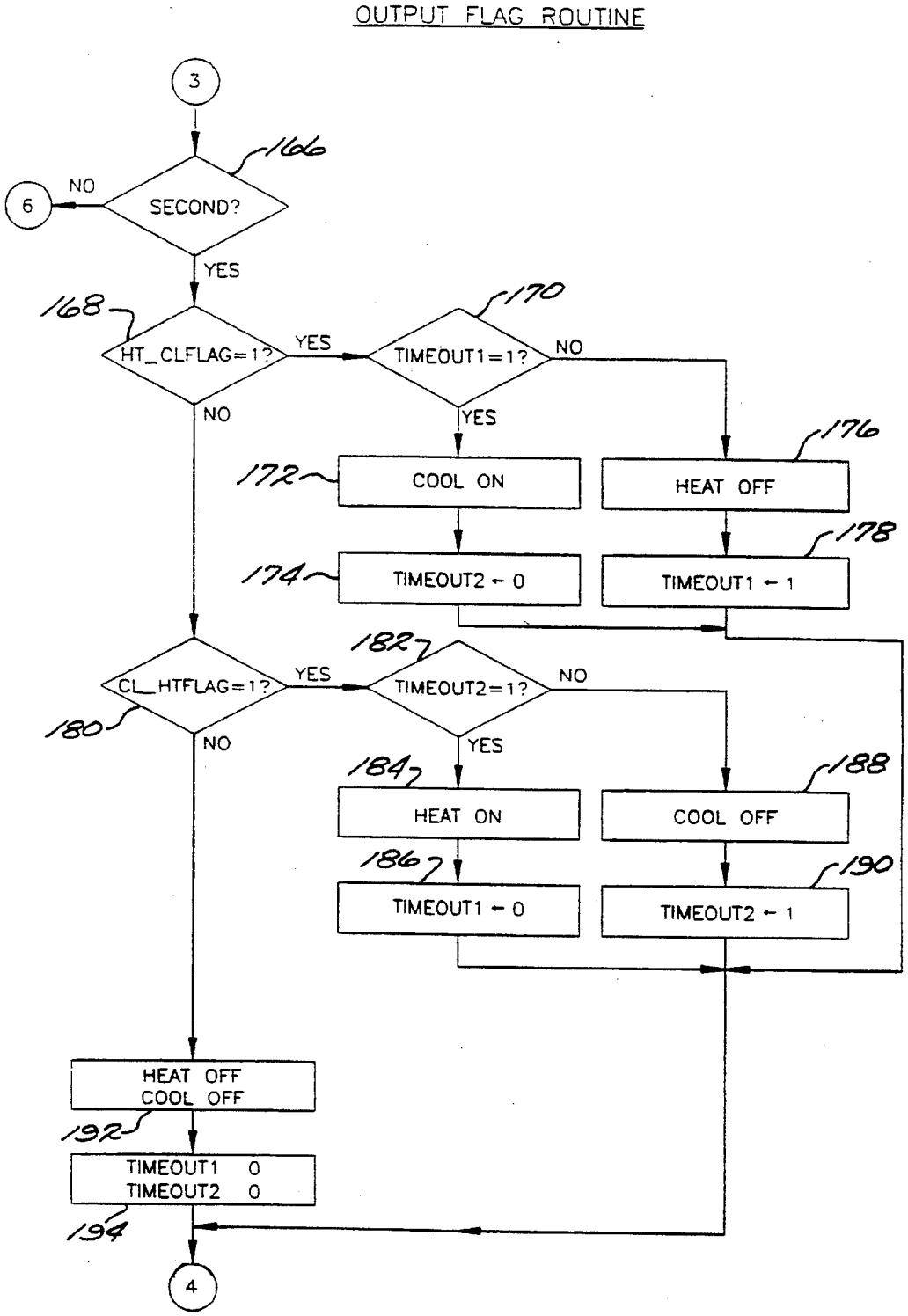
FIG. 10 is an output flag routine.

FIG. 10 relating to the output flag routine and including decision and processing blocks 166–194 ensures that the proper sequence of events occurs. That is, that the heat speed is turned off before the cool speed is turned on and the like.

Figure 11:
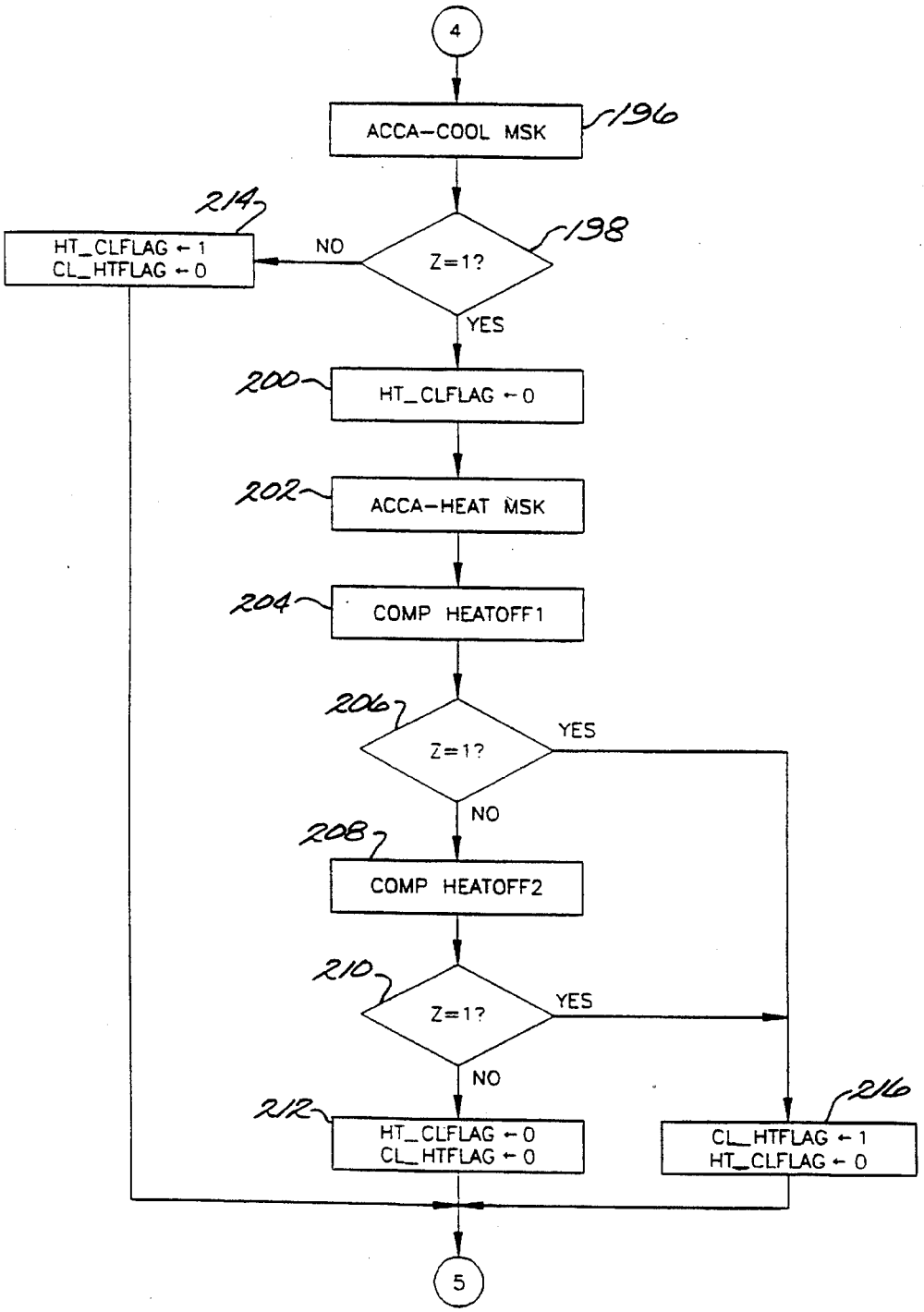
FIG. 11 is an output routine.
Figure 12:
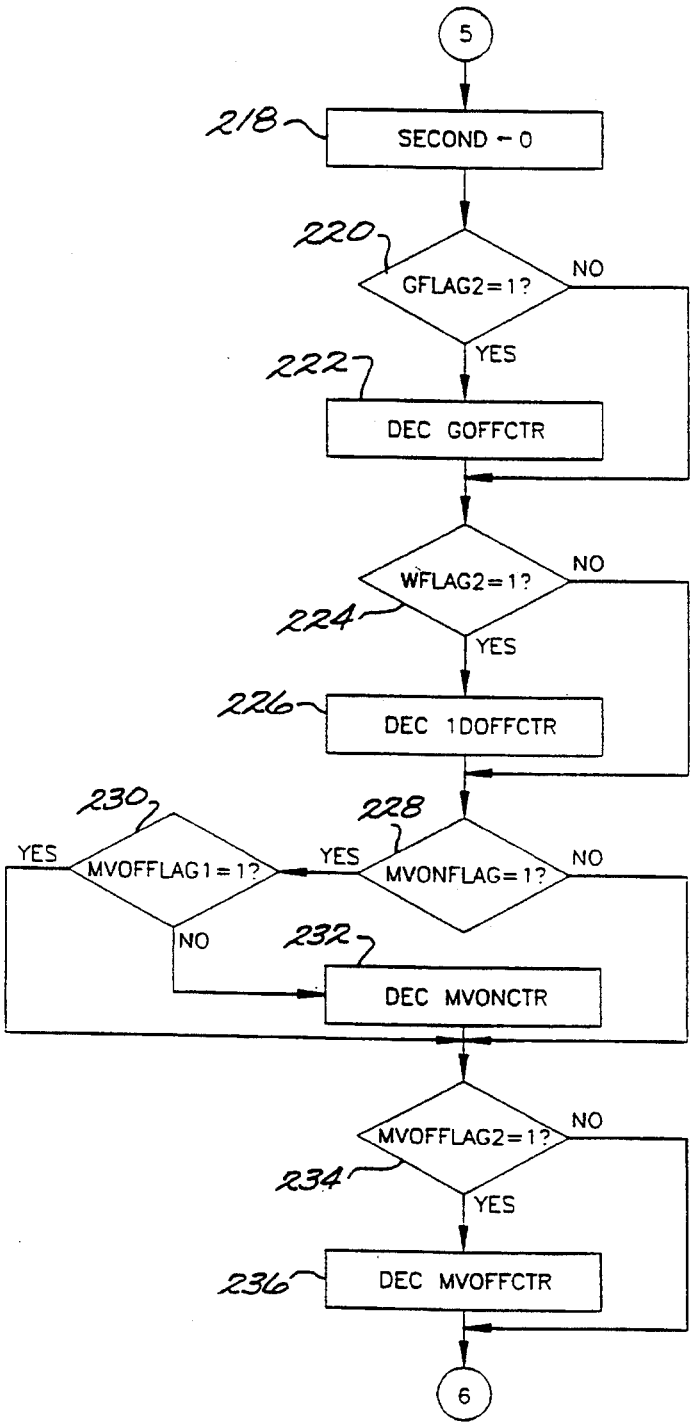
FIG. 12 is a counter routine.

FIGS. 11 and 12 show the output and counter routines respectively including decision and processing blocks 196–236 in which flags are set to transfer the output register in the RTI interrupt routine. Based on the conditions determined by a flag, e.g., if in time delay off then the counter is decremented, if not the routine skips to the next item.

Figure 13:
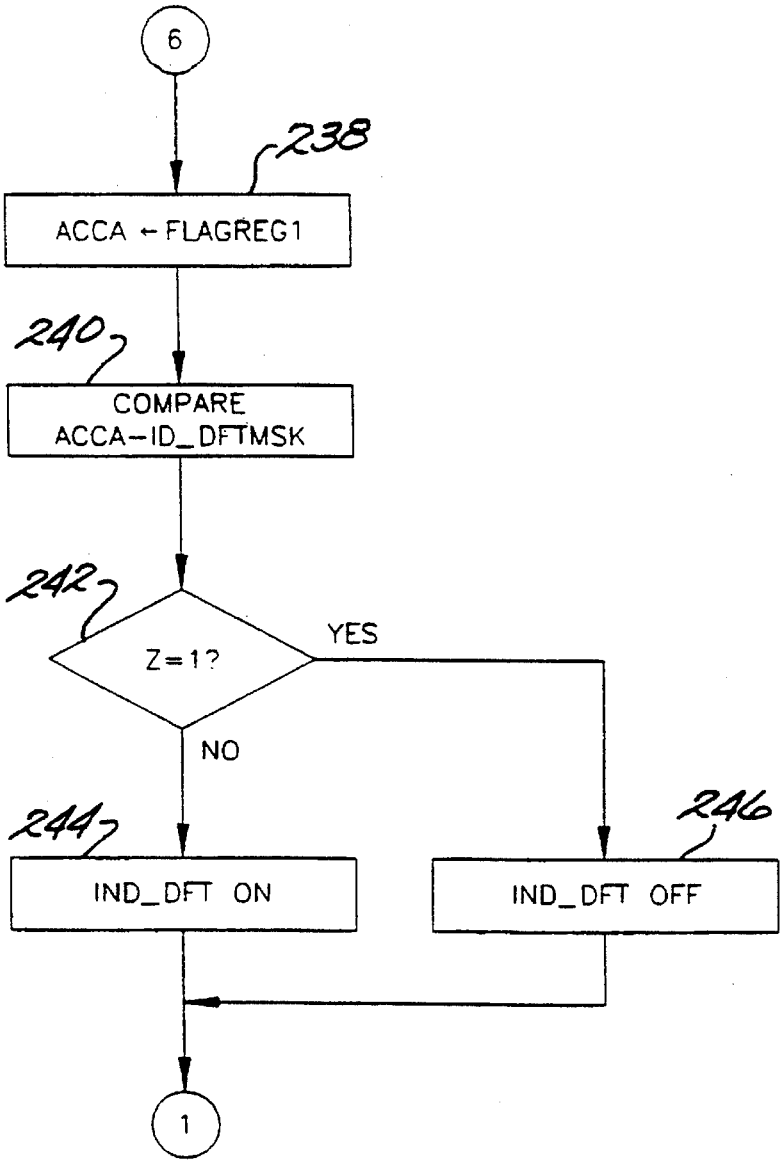
FIG. 13 is an induced draft output routine.

It will be seen in FIG. 13, relating to the induced draft output routine including processing blocks 238, 240, 244 and 246 and decision block 242, that competing speeds are not factors so that the 1 second flags is not a factor.

FIG. 14 shows the several counters and flags and their location in memory including flag register 1–248, inputs 250, flag register 2–252 and outputs 254 while FIGS. 15, 16 and 17 are truth tables of the inputs and outputs of heat and cool speeds and induced draft fan respectively.

Figure 18:
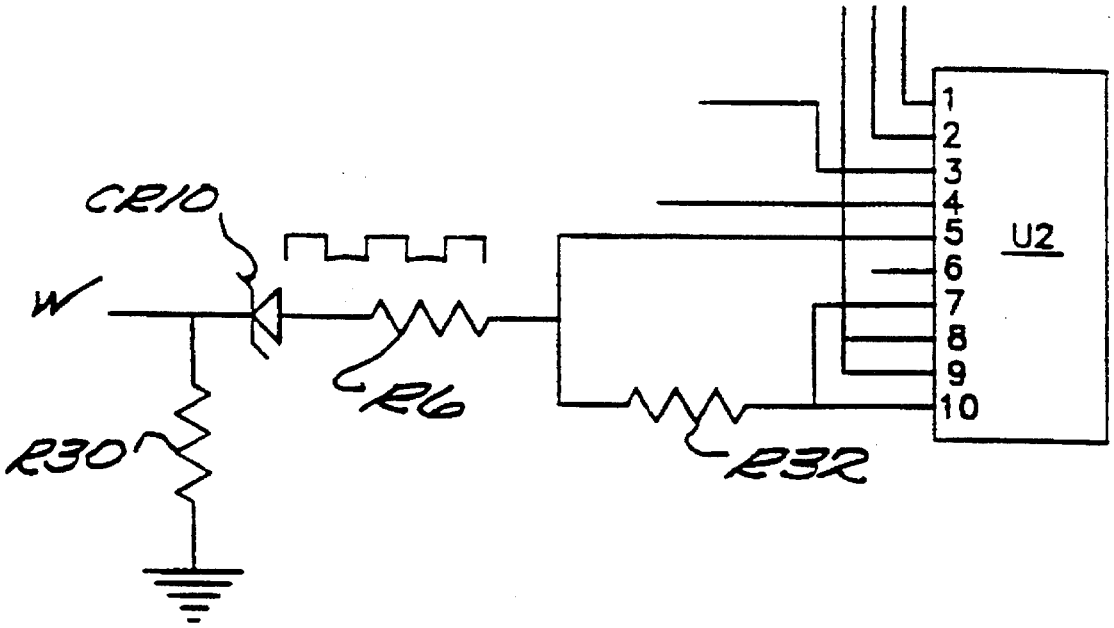
FIG. 18 shows a portion of the FIG. 2 schematic modified to provide electronic thermostat compatibility.

A modified embodiment is shown in FIG. 18 to make the control compatible for use with electronic thermostats. Electronic thermostats conventionally use one of the live thermostat lines as common and as long as the outputs have low impedance this does not cause a problem; however, when used with electronics of the type employed in the instant invention the two milliamperes or so of current can cause unintended operation, particularly in the heat request signal line in which the conventional time delay relays have been obviated by the circuit made in accordance with the invention. One way of dealing with this is to use a small pull down resistor, e.g., 500 ohms. In accordance with the modified embodiment a relatively small resistor R30, for example, a 2 watt resistor of 470 ohms, connects line W to AC ground. This will result in approximately twelve to fifteen milliamps which can still result in a wave form which has a hill in between consecutive highs when the thermostat line is closed. The addition of a 12 volt zener diode CR10 prevents turn on unless the voltage exceeds 12 volts so even if the electronic thermostat causes 20 milliamps there will only be seven or eight volts on the high side of the resistor R30 which will be insufficient to turn on diode CR10. Back to back zeners are not necessary since only the positive half of the wave form is considered as an input in the control of the present invention. This compatibility is achieved by modifying the FIG. 2 embodiment by a change in a resistor and the addition of a zener diode for the W and G signal lines. The two watt resistors can be accommodated conveniently by cutting a hole in the circuit board in alignment with each resistor to prevent overheating of the board. It is also preferable to add resistor R32 between port 5 of microprocessor U2 and DC ground, port 10 to prevent any spike of leakage current from causing a problem.

A control circuit made in accordance with the FIG. 2 embodiment comprised the following components:

| | | | | | |
|---|---|---|---|---|---|
| R1 | 1.5K ohms 5% 1 W | R11 | 39K ohms 5% ⅛ W | CR7 5.0 V | zener |
| R2 | 100K ohms 5% ⅛ W | R12 | 1.5K ohms 5% 1 W | CR1 | general purpose diode |
| R3 | 100K ohms 5% ⅛ W | R13 | 1.5K ohms 5% 1 W | CR2 | general purpose diode |
| R4 | 100K ohms 5% ⅛ W | R14 | 1.5K ohms 5% 1 W | CR3 | general purpose diode |
| R5 | 50K ohms 5% ⅛ W | R15 | 10K ohms 5% ⅛ W | CR4 | general purpose diode |
| R6 | 100K ohms 5% ⅛ W | R16 | 10K ohms 5% ⅛ W | CR5 | general purpose diode |
| R7 | 50K ohms 5% ⅛ W | R17 | 10K ohms 5% ⅛ W | CR6 | switching diode |
| R8 | 100K ohms 5% ⅛ W | C1 | 10 uf 63 VDC | U1 | MG8HC05J1 Motorola |
| R9 | 100K ohms 5% ⅛ W | C2 | .1 uf 50 VDC | U2 | ULN 2003A Texas Instruments |
| R10 | 10K ohms 5% ⅛ W | | | K1 | T90 Potter & Brumfield |

-continued

| | | |
|---|---|---|
| | K2 | T90 Potter & Brumfield |
| | K3 | T70 Potter & Brumfield |

Numerous variations and modifications of the invention will become readily apparent to those familiar with furnace controls. The invention should not be considered as limited to the specific embodiments depicted, but rather as defined in the claims.

We claims:

1. A control system having a low voltage AC power source, a low voltage AC input signal indicative of a selected condition, an output relay adapted to control a system component responsive to the low voltage AC input signal, the relay having electrical contacts relatively movable into and out of engagement with one another, means to determine the status of the AC input signal synchronously with the AC power source and means to effect at least one of contact engagement and contact disengagement asynchronously with the AC power source, the means to determine the status of the AC input signal synchronously with the AC power source includes microprocessor means having input and output ports including an interrupt IRO port and having a real time clock, the AC input signal coupled to an input port and the AC power source being coupled to the IRO port to detect an edge of the AC wave to read the AC input signal at the input port at a time related to the detection of said edge of the AC wave at the IRO port and means to energize the relay contacts from the output of the microprocessor means based on the real time clock so that the AC input signal is asynchronous relative to the AC power source.

2. A control system according to claim 1 in which both contact engagement and contact disengagement are effected asynchronously with the AC power source.

3. A control system having a low voltage AC power source, a plurality of low voltage AC input signals indicative of selected conditions, output relays adapted to control system components responsive to the low voltage AC input signals, the relays having electrical contacts relatively movable into and out of engagement with one another, means to determine the status of the low voltage AC input signals synchronously with the AC power source and means to effect at least one of contact engagement and contact disengagement asynchronously with the AC power source, the means to determine the status of the low voltage AC input signals synchronously with the AC power source includes microprocessor means having input ports including an interrupt IRQ port and having a real time clock, the low voltage AC power source being provided by transformer means having an AC voltage common connected to the IRQ port, means to detect the falling edge of the AC voltage common wave at the IRQ port and, after a delay of a quarter of an AC wave length, to read the AC input signals at the input ports.

4. A control system according to claim 3 in which the low voltage AC input signals are connected to the input ports and further including means to periodically calibrate reading of the input ports to assure that the reading is synchronous with the AC power source.

5. A control system according to claim 3 in which the low voltage input signals are connected to the input ports and the low voltage AC input signals are read at the peak of the low voltage AC input signal.

6. A control system according to claim 3 in which the low voltage AC input signals are connected to the input ports and the input ports are read a selected number of times before the microprocessor means generates an output.

7. A control system according to claim 3 in which the means to effect at least one of the contact engagement and contact disengagement asynchronously with the AC power source includes the microprocessor means, the microprocessor means having output ports and a real time clock and in which selected time delays determined by the real time clock are provided in the microprocessor means before an output is generated.

8. A control system having an AC power source, a plurality of AC input signals indicative of selected conditions, output relays adapted to control system components responsive to the AC input signals, the relays having electrical contacts relatively movable into and out of engagement with one another, means to determine the status of the AC input signals synchronously with the AC power source and means to effect at least one of contact engagement and contact disengagement asynchronously with the AC power source, the means to determine the status of the AC input signals synchronously with the AC power source includes microprocessor means having input ports including an interrupt IRQ port and having a real time clock, the AC power source being provided by transformer means having an AC common connected to the IRQ port, means to detect an edge of the AC common wave at the IRQ port and, after a delay of a quarter of an AC wave length, to read the AC input signals at the input ports.

* * * * *